US005080712A

United States Patent [19]

James et al.

[11] Patent Number: 5,080,712

[45] Date of Patent: Jan. 14, 1992

[54] OPTIMIZED DOUBLE PRESS-DOUBLE SINTER POWDER METALLURGY METHOD

[75] Inventors: William B. James, Cinnaminson; Robert J. Causton, Delran; John J. Fulmer, Mt. Laurel, all of N.J.

[73] Assignee: Hoeganaes Corporation, Riverton, N.J.

[21] Appl. No.: 525,254

[22] Filed: May 16, 1990

[51] Int. Cl.[5] ..... B22F 1/00; B22F 3/00

[52] U.S. Cl. ..... 75/229; 75/231; 75/246; 419/11; 419/14; 419/38; 419/39; 419/53; 419/54; 419/55; 419/57; 419/58

[58] Field of Search ..... 419/11, 39, 53, 54, 419/55, 14, 38, 58, 57; 75/231, 229, 246

[56] References Cited

U.S. PATENT DOCUMENTS

| | | | |
|---|---|---|---|
| 3,704,115 | 11/1972 | Wastenson et al. | 75/0.5 BC |
| 3,720,512 | 3/1973 | Yamaguchi et al. | 419/54 |
| 3,798,022 | 3/1974 | LeBrasse et al. | 75/0.5 BA |
| 3,901,661 | 8/1975 | Kondo et al. | 419/11 |
| 4,042,385 | 8/1977 | Miyake et al. | 419/11 |
| 4,253,874 | 3/1981 | Cundill | 75/246 |
| 4,266,974 | 5/1981 | Nitta et al. | 75/251 |

FOREIGN PATENT DOCUMENTS

| | | |
|---|---|---|
| 61-117202 | 6/1986 | Japan . |
| 61-163239 | 7/1986 | Japan . |

OTHER PUBLICATIONS

"Handbook of Powder Metallurgy": I. A. White, Stainless Steel Powders—Manufacturing Techniques and Applications, pp. 90–115, New Types of Metal Powders, Gordon and Breach, New York (1964).

Metals Handbook, 9th Edition, vol. 7, "Powder Metallurgy", *American Society for Metals*, (1984), pp. 4, 25–39, 100–104, 683, 351–359 and 360–368.

Metals Handbook, 8th Edition, vol. 4, "Forming", *American Society of Metals*, (1969), pp. 454–459.

Hausner, Henry H., *Handbook of Powder Metallurgy*, "Effect of Double Pressing & Sintering of the Properties of 304L Stainless Steel Powders", (by White, 1960), 1973, p. 299.

*Primary Examiner*—Brooks H. Hunt
*Assistant Examiner*—Leon Nigohosian, Jr.
*Attorney, Agent, or Firm*—Woodcock Washburn Kurtz Mackiewicz & Norris

[57] ABSTRACT

Methods for preparing sintered components from iron-containing and alloy steel powder are provided. The methods includes compacting a powder mixture in a die set at a pressure of at least about 25 tsi to produce a green compact which is then presintered at a temperature of about 1100°–1600° F. (593°–870° C.) for at least about 5 minutes to produce a presintered preform. The presintered preform is then compacted at a pressure of at least about 25 tsi to produce a double-pressed presintered preform, which is, in turn, sintered at a temperature of at least about 1000° C. for at least about 5 minutes to produce a sintered component having improved transverse rupture strength and a higher density.

19 Claims, 2 Drawing Sheets

OPTIMIZED DOUBLE PRESS-DOUBLE SINTER POWDER METALLURGY METHOD

FIELD OF THE INVENTION

This invention relates to procedures for sintering alloy powders, and more particularly, to achieving higher density and strength with selected double press—double sinter process parameters.

BACKGROUND OF THE INVENTION

Recent advances in powder metallurgy processing techniques have permitted specialized applications, such as in the aerospace and nuclear energy industries where rigorous mechanical properties and high quality are required. These processing techniques include selecting and producing the proper alloy powder, consolidation, presintering, sintering and post-consolidation forming. See Metals Handbook, 9th Edition, Vol. 7, "Powder Metallurgy", *American Society for Metals,* (1984), and Metals Handbook, 8th Edition, Vol. 4, "Forming", *American Society of Metals,* (1969), which volumes are hereby incorporated by reference.

For part designs which require higher mechanical strength and greater densities pre-alloyed powders, such as ANCORSTEEL 1000B and 4600V (Hoeganaes Corporation), are often the material of choice. These powders can be produced by water atomization of molten metal and have a homogeneous composition.

In a conventional powder metallurgy processing, iron based powders are mixed with a lubricant and graphite, and alloying additions, prior to compaction. Typical compaction pressures range from about 25 to about 70 tsi (tons per square inch) with a resulting green density of about 6.3 to about 7.0 g/cm$^3$.

Presintering, as it is known in the metallurgical arts, can be used to "delube" or burn off the admixed lubricant from the "green" compact and to impart sufficient strength to the green compact for handling. Usually, a delubing presinter is conducted at temperatures of about 430°-650° C. for about 30 minutes. Metals Handbook, 9th Edition, pp. 683. Presintering has also been employed at temperatures above about 2000° F. (1090° C.) for increasing the density of pure iron compacts by closing up large pores prior to sintering. Metals Handbook, 8th Edition, pp. 455-59.

Following presintering, repressing can be provided to the presintered preform where compaction is carried out similarly to the initial compaction step. The die and/or preform are usually lubricated.

The preform can then be sintered employing a continuous or batch-type sintering furnaces in dissociated ammonia for up to about one hour at 1090°-1320° C. (2000°-2400° F.).

While in the main, these conventional processing techniques for double pressed—double sintered iron powder have provided some increases in density and attendant mechanical properties, there remains a need for further improvement for specialized applications.

SUMMARY OF INVENTION

This invention provides novel methods for preparing sintered components from iron-based powder mixtures. In the methods of this invention, a iron-based powder mixture is compacted in a die set at a pressure of at least about 25 tsi to produce a green compact. The green compact is then presintered at a temperature of about 1100°-1600° F. (593°-870° C.), preferably about 1300°-1500° F. (700°-815° C.) for a time of at least 5 minutes to produce a presintered preform. These temperature ranges have been proven empirically to be important to obtaining optimum sintered densities associated with higher transverse rupture strengths.

Following presintering, the presintered preform is repressed at a pressure of at least about 25 tsi to produce a double-pressed, presintered preform, which, in turn, is sintered at a temperature of at least about 1000° C. for at least about 5 minutes to produce a sintered component.

The methods of this invention provide carefully controlled parameters, including specific presintering temperatures, compaction pressures, and sintering temperatures, for optimizing sintered density in the final component with significant gains in mechanical properties. Without committing to any particular theory, it is believed that the selected range of presintering temperatures of this invention permit effective vaporization of the lubricant from the compact preform. Substantially eliminating all traces of lubricant increases the resulting density of the component by eliminating organic compounds which could occupy space. By substantially eliminating these lubricant traces, this space can now be filled with iron.

The chosen temperatures of the presintering step also permit more effective annealing of the deformed metal in the green compact. During full compaction, the iron-containing powder undergoes significant cold working with corresponding increases in the hardness of the iron-containing particles. Conventional delubing presinter temperatures of about 430°-650° C. do not sufficiently anneal the green compact and subsequent pressing steps would therefore be limited by the hardness of the iron-containing particles, resulting in a final component density which is less than optimal. By more fully annealing the compact preform during the presintering heat treatment, the iron-containing particles are softer and can deform more in the second compaction step for providing increased density to the double pressed preform prior to the sintering step.

With respect to the higher end of the selected presintering temperature range of this invention, experimental results show that the sintered density starts to drop in prealloyed powder samples when the presintering temperature exceeds about 1500° F. (815° C.), with a significant loss in density found at presintering temperatures above about 1600° F. (870° C.). This result is believed to be caused, in part, by increased diffusion of carbon and other alloying ingredients into the soft iron phases of the powder, which creates harder phases. These harder phases make the preform more difficult to compact during repressing, which results in a lower sintered density in the final component. Prior art presintering temperatures of greater than 2000° F. (1090° C.) applied to pure iron powders, without significant alloying additions, would not suggest the presintering temperature ranges of this invention since hard phases would not develop in the absence of these alloying additions.

Accordingly, improvements to the strength and density of sintered components are achieved by carefully selecting the presintering temperature in a double pressed—double sintered powder metallurgy procedure. The methods of this invention can be effectively employed with prealloyed, diffusion bonded iron powders, and iron powders mixed with free alloying ingredients, with similar increases in density and performance.

BRIEF DESCRIPTION OF THE DRAWINGS

The accompanying drawings illustrate comparative test results demonstrating the critical nature of the processing steps of this invention, and in which.

DETAILED DESCRIPTION OF THE INVENTION

Figure 1:
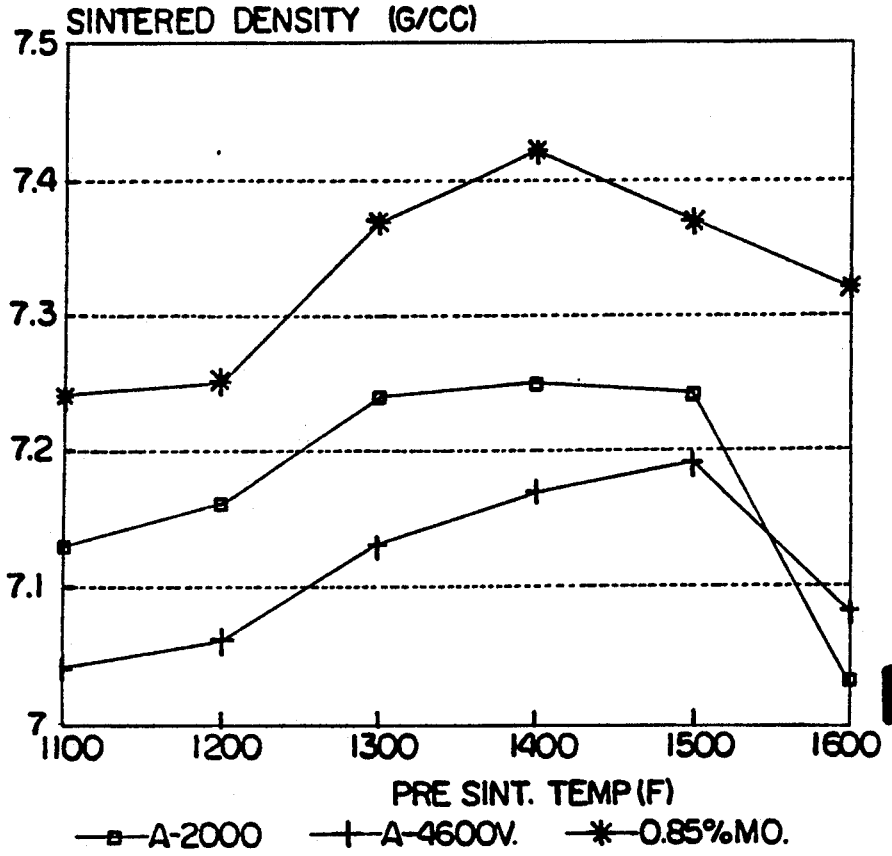
FIG. 1: is a graphical depiction of sintered density versus presintering temperature for 0.85 wt. % Mo (ANCORSTEEL 85 HP), A2000 (ANCORSTEEL 2000), and A4600V (ANCORSTEEL 4600V) powders.

This invention provides a method for preparing a sintered component from an iron-based powder mixture which includes the steps of compacting the iron powder mixture having at least one alloying ingredient in a die set at a pressure of at least about 25 tsi to produce a green compact, presintering this green compact at a temperature of about 1100°-1600° F. (593°-870° C.), for a time of at least about 5 minutes to produce a presintered preform, compacting th presintered preform at a pressure of at least about 25 tsi to produce a double-pressed, presintered preform, and sintering the double-pressed, presintered preform at a temperature of at least 1000° C. for at least about 5 minutes to produce a sintered component. The sintered components of this invention, thus produced, have demonstrated significant improvements in density and transverse rupture strength.

In an alternative embodiment of this invention, a method of preparing a sintered component is provided which includes providing a powder mixture comprising less than about 1 wt. % graphite, less than about 1 wt. % lubricant and a balance comprising iron-based, prealloyed powder, preferably containing about 0.5-2.5 wt. %Mo. The powder mixture is compacted at a pressure of about 30-60 tsi to produce a green compact, which is then presintered at a temperature of about 1300°-1500° F. (700°-815° C.) for a time of about 25-30 minutes to produce a presintered preform. This presintered preform is then compressed at a pressure of about 30-60 tsi to produce a double-pressed presintered preform, which, in turn, is sintered at a temperature of about 2000°-2400° F. (1090°-1320° C.) for a time of about 15-60 minutes to produce a sintered component.

In still a more detailed method of this invention, a sintered component is made from a prealloyed powder mixture comprising about 0.6 wt. % graphite and about 0.5 wt. % lubricant and a balance containing low alloy steel powder. This powder mixture is compacted at a pressure of about 50 tsi to produce a green compact which is then presintered at a temperature of about 1400° F. (760° C.) for a time of about thirty minutes to produce a presintered preform. This presintered preform is compacted at a pressure of about 50 tsi to produce a double-pressed, presintered preform, which, in turn, is then sintered at a temperature of at least about 2000° F. (1090° C.) for a time of about thirty minutes to produce a sintered component.

The powder mixtures of this invention preferably contain iron or steel, good examples of which include diffusion-bonded and prealloyed, low-alloy steel, although iron powders with free alloying ingredients are also acceptable. Most low-alloy steels can be readily manufactured with water-atomizing techniques. Some of the many powders which are capable of being manufactured into sintered components pursuant to the methods of this invention are listed below in Table 1.

TABLE 1

Typical Ferrous Powder Compositions
COMPOSITION, Weight %

| Designation or Tradename | Composition | | | | | | | | | |
|---|---|---|---|---|---|---|---|---|---|---|
| | Fe | Ni | Mo | Mn | Cr | Cu | P | S | Si | C |
| Ancor MH-100 | Bal. | — | — | — | — | — | 0.01 | 0.01 | 0.20 | 0.02 |
| Ancorsteel 1000 | Bal. | 0.08 | — | 0.02 | 0.07 | 0.10 | 0.009 | 0.018 | <0.01 | <0.01 |
| Ancorsteel 1000B | Bal. | 0.05 | — | 0.10 | 0.03 | 0.05 | 0.005 | 0.009 | <0.01 | <0.01 |
| Ancorsteel 1000C | Bal. | 0.04 | — | 0.07 | 0.02 | 0.03 | 0.004 | 0.007 | <0.01 | <0.01 |
| Ancorsteel 2000 | Bal. | 0.47 | 0.58 | 0.28 | 0.06 | 0.10 | 0.011 | 0.023 | 0.02 | <0.01 |
| Ancorsteel 4600V | Bal. | 1.84 | 0.54 | 0.17 | 0.07 | 0.11 | 0.012 | 0.022 | 0.02 | 0.01 |
| Ancorsteel 85 HP | Bal. | <0.08 | 0.80-0.90 | <0.20 | <0.10 | | <0.20 total | | | — |

With respect to a particularly preferred powder composition to be processed according to this invention, it has been found that when iron powder is simply prealloyed with Mo, the compressibility of the resulting powder is not significantly different from that of pure Fe powder, despite the fact that the alloyed-in (dissolved) Mo has a significantly greater atomic size than Ni or other heretofore used alloying elements and would otherwise be expected to increase the hardness of the pre-alloyed powder. Additionally, Mo-constituent powders showed significant improvements in density and Transverse Rupture Strength (TRS) when compared to samples which included higher Mn and Ni concentrations. For the surface hardness of the final sintered product to reach a practically useful value, a minimum quantity of 0.5 wt. % Mo is required to be pre-alloyed or otherwise present in such powder mixtures. At a content of 2.5 wt. % of molybdenum, the practical upper limit for the quantity of Mo that should be pre-alloyed is reached with respect to the density requirement of the finished part. Furthermore, a higher content than 2.5 wt. % leads to greater shrinkage during sintering and consequently poorer dimensional accuracy of the finished part. The upper limit of about 2.5 wt. % Mo is therefore established for reasons of compressibility, dimensional stability and cost. The quantity of Mo preferred is about 0.75-2.0 wt. %. More preferred is a quantity of about 0.75-1.5 wt. % Mo. A composition having about 0.8-0.9 wt. % Mo, and specifically 0.85 wt. % Mo, has been found to be particularly useful for the operations and purposes herein described. At these values, good compressibility, surface hardness, and hardenability are achieved. In the preferred Mo-containing alloy powders of this invention, the total weight of impurities such as Mn, Cr, Si, Cu, Ni and Al should not exceed 0.4 wt. %, while Mn itself should be no more than 0.25 wt. %. Furthermore, the C content should not exceed 0.02 wt. %.

With respect to the double-press, double sinter method of this invention generally, mixing of a suitable lubricant and graphite with the ferrous or steel powders is preferred before the initial compaction step of a double press—double sinter process. Standard lubricants, such as stearates or waxes, in amounts up to about 0.2–1.0 wt. %, are commonly used. Graphite in flake powder form is preferably added, if at all, in amounts up to about 0.2–1.0 wt. %, to obtain the desired carbon content in the final product. Accordingly, carbon need not be introduced in the original iron powder, although in some instances this may be desired. The amount of graphite added is about equal to the desired combined carbon content of the sintered preform plus an additional small amount to counteract losses caused by oxide content in the powder. These losses are due to the carbon-oxygen reduction reaction of the sintering process. Blending of constituents can be accomplished by mixing in a blender for about 30 minutes–1 hour. Although good results have also been obtained with ANCORBOND ® bonded premixes.

Following blending, the powders are compacted, typically using closed, confined die sets. Preferably, the compaction pressure is set at least about 25 tsi, preferably 25–70 tsi, more preferably about 30–60 tsi, and most preferably above about 50 tsi for producing a green compact. Double-action or multi-motion floating die sets are generally recommended for minimizing density gradients in the green compact.

After compacting, the green compact is presintered at a temperature of about 1100°–1600° F. (593°–870 ° C.), preferably about 1300°–1500° F. (700°–815° C.) and most preferably about 1400° F. (760° C.), for at least about 5 minutes, preferably about 25–35 minutes, and most preferably about 30 minutes, to produce a presintered preform.

After presintering, the preform is then compacted again, preferably within the same confined die to further reduce the porosity of the preform prior to full sintering. The presintered preform is compacted under a pressure of at least 25 tsi, preferably about 25–70 tsi, more preferably about 30–60 tsi, and most preferably above about 50 tsi, to produce a double-pressed, presintered preform. In the preferred embodiments of this invention, the compacting pressure for the first and second compaction steps of the double-pressed process employ the same pressure.

The double-pressed, presintered preform is then subjected to a sintering operation which can be conducted in continuous or batch-type sintering furnaces. The preforms are heated, preferably in a non-oxidizing, and preferably reducing, environment, for example, endothermic gas, hydrogen, synthetic nitrogen or dissociated ammonia based atmospheres. The sintering temperature should be at least about 1830° F. (1000° C.), preferably about 2000°–2400° F. (1090°–1320° C.) and most preferably about 2300° F. (1260° C.). The preform should be sintered for at least about 5 minutes, preferably about 15–60 minutes and most preferably about 30 minutes to produce a sintered component. Following sintering, additional reconsolidation operations can be undertaken if full or near-full density is required. Typical post-sintering forming operations include coining, extrusion and hot forging.

This invention will be further understood within the context of the following examples.

EXAMPLE I

Experimental premixes were prepared using HOEGANAES ANCORSTEEL 2000 powder which was premixed with 0.6 wt. % Southwestern 1651 graphite and about 0.5 wt. % lubricant, Lonza Acrawax-C. The ingredients were weighed, then premixed for 15 minutes in a laboratory blender. Preweighed quantities of the test premixes were compacted to Transverse Rupture test pieces pursuant to MPIF Standard 41 (1985–6). The test pieces were compacted at 45 tsi using a Tinius Olsen compression, testing machine. The density of the "green" test pieces was estimated by weighing and taking dimensional measurements of the pieces. Individual test pieces were then presintered at temperatures of 1100° F. (593° C.), 1200° F. (649° C.), 1300° F. (704° C.), 1400° F.(760° C.), 1500° F.(816° C.) and 1600° F. (871° C.) respectively, and were then held at each temperature for 30 minutes under a dissociated ammonia atmosphere. Upon cooling to room temperature, the densities of the bars were estimated, again by weighing and taking dimensional measurements. The presintered bars were again pressed at 45 tsi using the Tinius Olsen press. The repressed densities were determined prior to sintering. Following the second compaction step, the repressed bars were sintered at 2300° F. (1260° C.) for 30 minutes under dissociated ammonia atmosphere. Upon cooling to room temperature, the densities of the bars were again calculated. The bars were slightly machined for fit and then broken in 3-point bending using a Tinius Olsen 5000 testing machine. The Transverse Rupture Stress (TRS) was calculated following MPIF Standard 41 (1985–6) specifications. The values quoted below were obtained by calculating the mean of five determinations per test condition for all the results except TRS, which only included two bars per test condition.

TABLE 2

| | | A2000 | | |
|---|---|---|---|---|
| Temp. (°F.) | Presintered Density (g/cm³) | Final Density (g/cm³) | TRS (psi) | Hardness HRB |
| 1100 | 6.91 | 7.13 | 151,970 | 78 |
| 1200 | 6.91 | 7.16 | 154,020 | 80 |
| 1300 | 6.92 | 7.24 | 154,340 | 82 |
| 1400 | 6.93 | 7.25 | 164,340 | 81 |
| 1500 | 6.95 | 7.24 | 166,470 | 81 |
| 1600 | 6.91 | 7.03 | 137,130 | 75 |

EXAMPLE II

Experimental premixes were prepared using HOEGANAES ANCORSTEEL 4600V alloy steel base powder employing the same process parameters and number of samples as described in Example I. The following results were obtained.

TABLE 3

| | | A4600V | | |
|---|---|---|---|---|
| Temp. (°F.) | Presintered Density (g/cm³) | Final Density (g/cm³) | TRS (psi) | Hardness HRB |
| 1100 | 6.81 | 7.04 | 145,420 | 79 |
| 1200 | 6.81 | 7.06 | 150,190 | 79 |
| 1300 | 6.82 | 7.13 | 157,900 | 81 |
| 1400 | 6.83 | 7.17 | 162,270 | 82 |

TABLE 3-continued

| Temp. (°F.) | Presintered Density (g/cm³) | A4600V Final Density (g/cm³) | TRS (psi) | Hardness HRB |
|---|---|---|---|---|
| 1500 | 6.84 | 7.19 | 165,730 | 83 |
| 1600 | 6.83 | 7.08 | 149,350 | 77 |

EXAMPLE III

Experimental premixes were prepared using HOEGANAES ANCORSTEEL 85 HP low alloy steel (0.85 wt. % Mo) base powders employing the same process parameters and number of test specimens as described in Example I. The following test results were obtained.

TABLE 4

| Temp. (°F.) | Presintered Density (g/cm³) | 0.85% Mo Final Density (g/cm³) | TRS (psi) | Hardness HRB |
|---|---|---|---|---|
| 1100 | 7.05 | 7.24 | 172,830 | 84 |
| 1200 | 7.04 | 7.25 | 173,410 | 85 |
| 1300 | 7.05 | 7.37 | 189,260 | 85 |
| 1400 | 7.06 | 7.42 | 199,790 | 89 |
| 1500 | 7.08 | 7.37 | 192,880 | 87 |
| 1600 | 7.10 | 7.32 | 181,680 | 84 |

EXAMPLE IV

Experimental premixes were prepared using HOEGANAES ANCORSTEEL 85 HP low alloy steel (0.85 wt. % Mo) base powders employing substantially the same process parameters and number of test specimens as described in Example I. However, the repressed bars were sintered at about 2050° F. (1120° C.), for thirty minutes under a dissociated ammonia atmosphere. The following test results were obtained.

TABLE 5

| Temp. (°F.) | Presintered Density (g/cm³) | Final Density (g/cm³) | TRS (psi) | Hardness HRB |
|---|---|---|---|---|
| 1100 | 7.05 | 7.24 | 166,372 | 82 |
| 1200 | 7.04 | 7.25 | 169,839 | 83 |
| 1300 | 7.05 | 7.37 | 194,874 | 88 |
| 1400 | 7.06 | 7.42 | 196,924 | 87 |
| 1500 | 7.08 | 7.37 | 196,523 | 87 |
| 1600 | 7.10 | 7.32 | 160,294 | 80 |

Final sinter performed at 2050°

Referring to now the Figures, the results of these experimental parameters on the effect of presintering temperature upon the final sintered density of double pressed and double sintered low alloy steel premixes will now be discussed. It was found that an optimum presintering temperature of approximately 760° C. existed for these alloys. Presintering at this temperature increased the final component density by approximately 0.2 g/cm³ over other temperatures in the range of about 593° C. to about 871° C. The increased density significantly increased the transverse rupture stress values of the sintered test pieces.

The presintered density of the 0.85 wt. % Mo steel compact, following initial compaction and presintering, increased slightly with increasing presintering temperatures from about 704° C. to about 816° C., as described in FIG. 1. For A2000 and A4600V compacts, it appears that the presintered density reached a maximum at about 816° C., then decreased slightly at 871° C.

Figure 2:
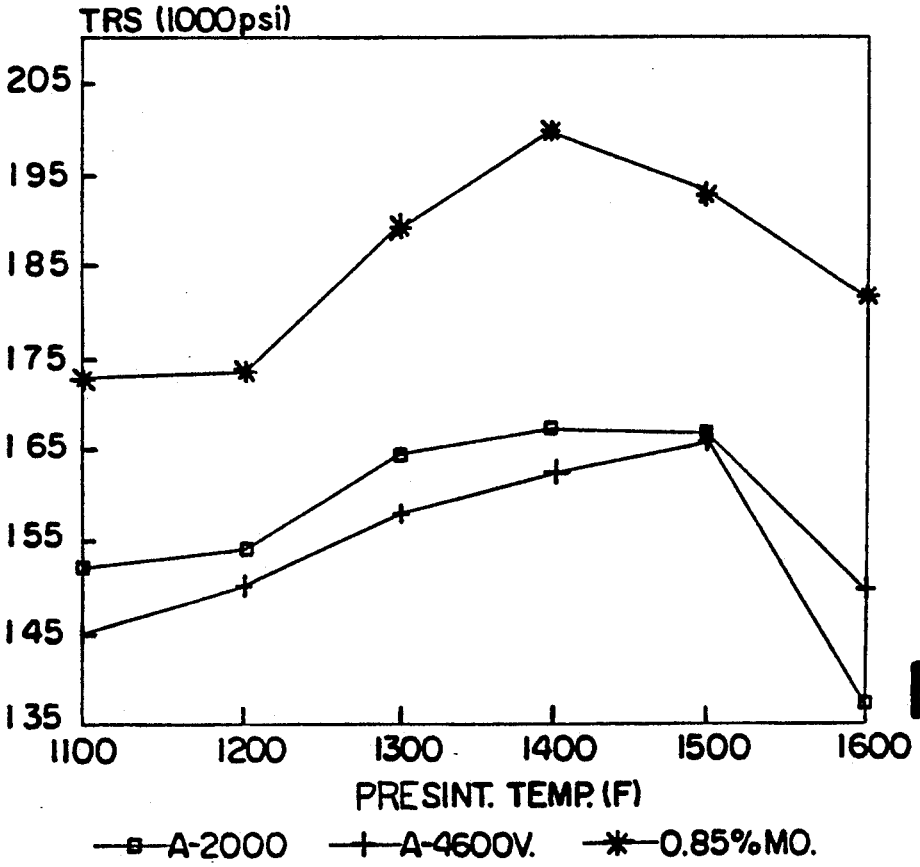
FIG. 2: is a graphical depiction of transverse rupture strength versus presintering temperature for the powders of FIG. 1.

The final density, i.e., the density following repressing and sintering, reached a maximum value at approximately 760° C. for both A2000 and the 0.85 wt. % Mo steel powder samples as described in FIG. 2. For the A4600V sample, maximum density was achieved following presintering a about 816° C. For A2000 and 0.85 wt. % Mo steels, the maximum final density was achieved at a slightly lower presintering temperature than that which produced a maximum presintering density.

Figure 3:
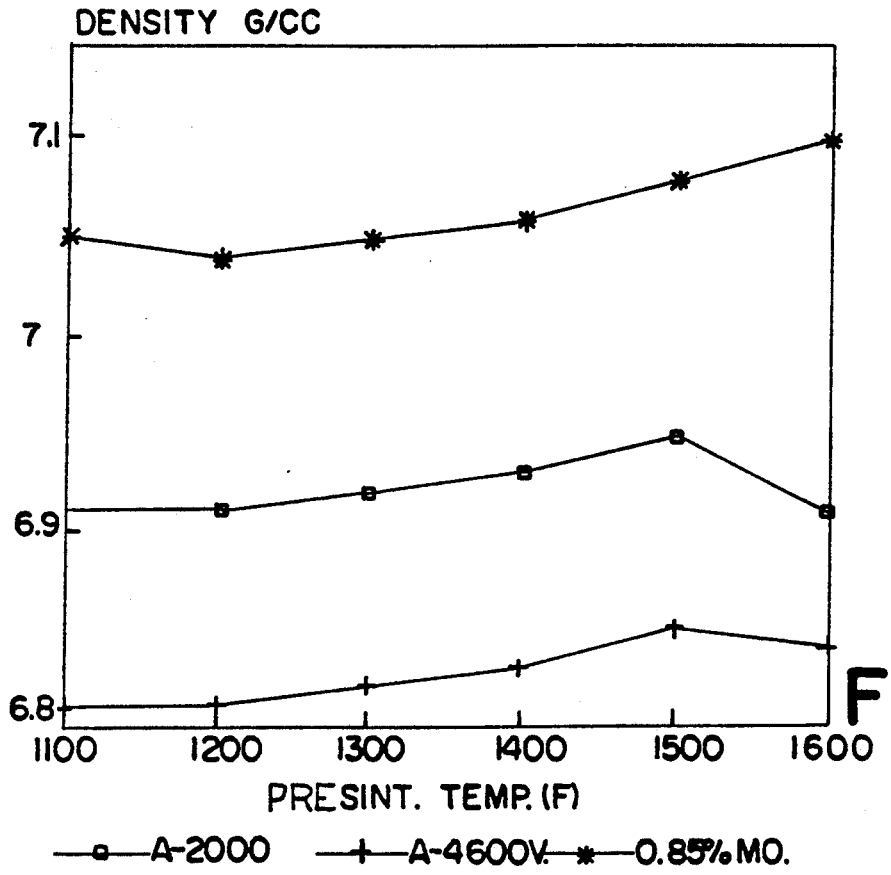
FIG. 3: is a graphical depiction of the density before repressing versus presintering temperature for the powders of FIG. 1.
Figure 4:
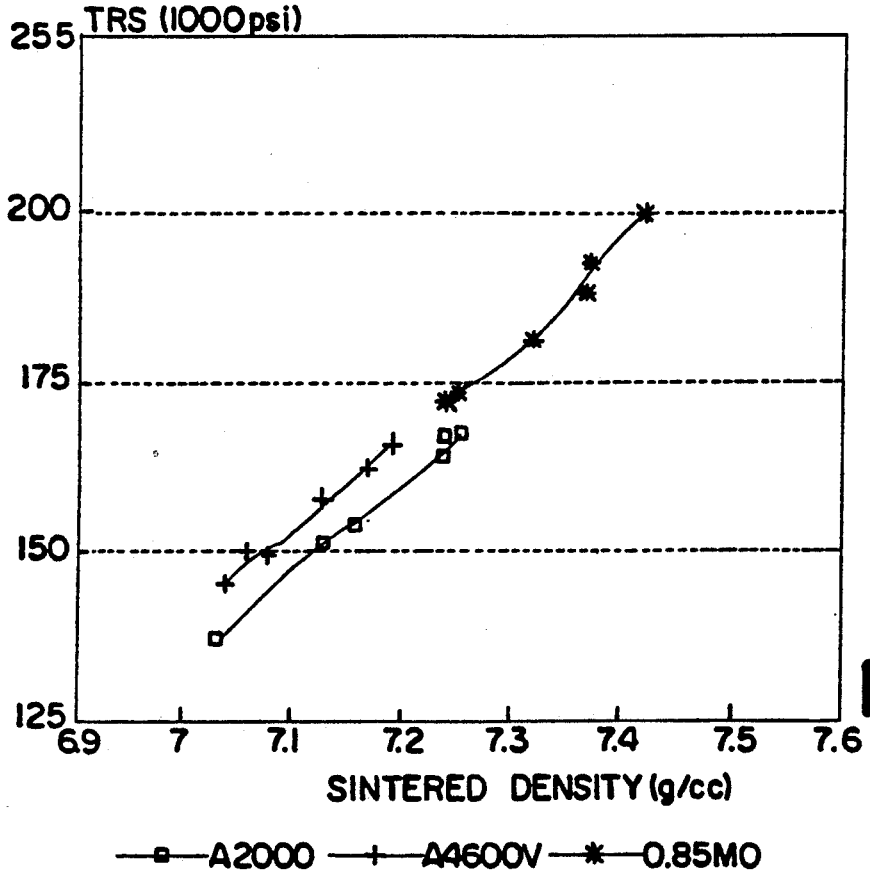
FIG. 4: is a graphical depiction of transverse rupture strength versus sintered density for the steel powders of FIG. 1.

The influence of presintering temperature on transverse rupture stress value is illustrated in FIG. 3. Presintering at about 760° C. produced maximum TRS values for the 0.85 wt. % Mo steel and A2000. For A4600V, the maximum TRS value was obtained at 816° C. In all steels, TRS values increase significantly with increasing final density as described in FIG. 4. The TRS values of the 0.85 wt. % Mo steel was significantly higher than those achieved for both the A2000 and A4600V. The increase in density and TRS values was not shown to decrease significantly even when the final sintering temperature was reduced to about 2050° F. (1120° C.) (compare Tables 4 and 5).

From the foregoing it can be realized that this invention provides optimized presintering temperature ranges for significantly increasing the final density achieved in double-pressed and double sintered iron or low-alloy steels powders. Additionally, it has been demonstrated that the sintered transverse rupture stress increased with increasing final density, as a direct result of the greater compressibility achieved by the selected presintering temperatures of this invention. Although various embodiments have been illustrated, this was for the purpose of describing, but not limiting the invention. Various modifications, which will become apparent to one skilled in the art, are within the scope of this invention described in the attached claims.

What is claimed is:

1. A method for preparing a sintered component from an iron-based powder mixture comprising:

(a) providing an iron-based powder mixture including:

atomized, prealloyed, iron-based powder comprising iron and an effective amount of at least one alloying element selected from the group consisting of molybdenum, manganese, nickel and chromium; and graphite in an amount of about 0.2 to about 1 wt. %;

(b) compacting said powder mixture in a die set at a pressure of at least about 25 tsi to produce a green compact;

(c) presintering said green compact at a temperature of about 1100°-1600° F. (593°-870° C.) for a time of at least about 5 minutes to produce a presintered preform;

(d) compacting said presintered preform at a pressure of at least about 25 tsi to produce a double-pressed, presintered preform; and (e) sintering said double-pressed, presintered preform at a temperature of at least about 1830° F. (1000° C.) for at least about 5 minutes to produce said sintered component having a density that is at least about 93.1% of theoretical density.

2. The method of claim 1 wherein said powder mixture comprises; less than about 1 wt. % lubricant and a balance comprising prealloyed, low-alloy steel powder.

3. The method of claim 2 wherein said compacting step (b) comprises applying a pressure of about 30–60 tsi, and said presintering step (c) is performed at a temperature of about 1300°–1500° F. (700°–815° C.).

4. The method of claim 3 wherein said presintering step (c) is performed for a time of about 25–35 minutes.

5. The method of claim 4 wherein said compacting step (d) comprises applying a pressure of about 30–60 tsi.

6. The method of claim 5 wherein said sintering step (e) comprises heating to a temperature of about 2000–2400° F. (1090°–1320° C.) in a reducing atmosphere. (1090°–1320° C.) in a reducing atmosphere.

7. The method of claim 6 wherein said sintering step (e) is performed for a time of about 15–60 minutes.

8. The method of claim 1 wherein said atomized, prealloyed, iron-based powder contains dissolved molybdenum in an amount of about 0.5–2.5 wt. % as an alloying element.

9. The method of claim 8 wherein said atomized powder contains about 0.75–2.0 wt. % molybdenum.

10. The method of claim 8 wherein said atomized powder contains about 0.8–0.9 wt. % molybdenum.

11. The method of claim 10 wherein said atomized powder comprises less than about 0.02 wt. % carbon.

12. The method of claim 11 wherein said atomized powder has a total of any contained manganese, chromium, silicon, copper, nickel and aluminum of no greater than about 0.4 wt. %.

13. A method for preparing a sintered component from an iron-based powder mixture comprising:

(a) providing a powder mixture comprising from about 0.2 to about 1 wt. % graphite, less than about 1 wt. % lubricant and prealloyed, iron-based powder comprising iron and an effective amount of at least one alloying element selected from the group consisting of molybdenum, manganese, nickel and chromium;

(b) compacting said powder mixture at a pressure of about 30–60 tsi to produce a green compact;

(c) presintering said green compact at a temperature of about 1300°–1500° F. (700°–815° C.) for a time of about 25–30 minutes to produce a presintered preform;

(d) compressing said presintered preform at a pressure of about 30–60 tsi to produce a double-pressed, presintered preform; and (e) sintering said double-pressed, presintered preform at a temperature of about 2000°–2400° F. (1090°–1320° C.) for a time of about 15–60 minutes to produce a sintered component having a density that is at least about 93.1% of theoretical density.

14. The method of claim 13 wherein said powder mixture comprises about 0.3 wt. % Mn, 0.60 wt. % Mo and about 0.45 wt. % Ni.

15. The method of claim 13 wherein said powder mixture comprises about 0.23 wt. % Mn, 0.48 wt. % Mo, and 1.77 wt. % Ni.

16. The method of claim 13 wherein said powder mixture comprises less than about 0.2 wt. % Mn, and about 0.85 wt. % Mo.

17. A sintered component produced by the process of claim 1.

18. A sintered component produced by the process of claim 13.

19. A method for preparing a sintered component from a prealloyed powder mixture comprising:

(a) providing a powder mixture comprising about 0.6 wt. % graphite and about 0.5 wt. % lubricant and a balance containing prealloyed, iron-based powder comprising iron and an effective amount of at least one alloying element selected from the group consisting of molybdenum, manganese, nickel and chromium;

(b) compacting said powder mixture at a pressure of at least about 50 tsi to produce a green compact;

(c) presintering said green compact at a temperature of about 1500° F. (760° C.) for a time of about 30 minutes to produce a presintered preform;

(d) compacting said presintered preform at a pressure of at least about 50 tsi to produce a double-pressed, presintered preform; and (e) sintering said double-pressed presintered preform at a temperature of at least about 2000° F. (1090° C.) for a time of about 30 minutes to produce a sintered component having a density that is at least about 93.1% of theoretical density.

* * * * *

US005080712B1

REEXAMINATION CERTIFICATE (3040th)

United States Patent [19]

[11] B1 5,080,712

James et al.

[45] Certificate Issued Oct. 29, 1996

[54] OPTIMIZED DOUBLE PRESS-DOUBLE SINTER POWDER METALLURGY METHOD

[75] Inventors: William B. James, Cinnaminson; Robert J. Causton, Delran; John J. Fulmer, Mt. Laurel, all of N.J.

[73] Assignee: Hoeganaes Corporation, Riverton, N.J.

Reexamination Requests:
No. 90/002,675, Mar. 16, 1992
No. 90/003,031, Apr. 15, 1993

Reexamination Certificate for:

| | |
|---|---|
| Patent No.: | **5,080,712** |
| Issued: | **Jan. 14, 1992** |
| Appl. No.: | **525,254** |
| Filed: | **May 16, 1990** |

[51] Int. Cl.[6] ..... B22F 1/00; B22F 3/00

[52] U.S. Cl. ..... 75/229; 75/231; 75/246; 419/11; 419/14; 419/38; 419/39; 419/53; 419/54; 419/55; 419/57; 419/58

[58] Field of Search ..... 75/229, 231, 246; 419/11, 14, 38, 39, 53, 54, 55, 57, 58

[56] References Cited

U.S. PATENT DOCUMENTS 4,266,974 5/1981 Nitta et al. ..... 75/251

OTHER PUBLICATIONS

Hoeganaes Corporation, Technical Data Sheet: Distaloy 4600A and 4800A, Oct. 1987.

Hoeganaes Corporation, Technical Data Sheet: Ancorsteel 4600V, Feb. 1988.

Kobe Steel, Atomized Steel Powder (Commercial Brochure), 1988.

M. Satoh, et al., "Characteristics of Low-Alloy Sintered Material After Cold Repressing," Advances in Powder Metallurgy, vol. 1, Jun. 11-14, 1989.

Y. Morioka, et al., "Recent Developments in Low-Alloy Steel Powders," Modern Developments in Powder Metallurgy, vol. 21, Jun. 5-10, 1988.

Sumitomo Metal, Technical Data Sheet: Sumiron 4100S, 1985.

B. Lindqvist, "Influence of Microstructure and Porosity on Fatique Properties of Sintered Steels," 10.10.Modern Developments in Powder Metallurgy, vol. 21, Jun. 5-10, 1988.

S. Mocarski, et al. "Powder Metal Parts for Automotive Application-Part 3", SAE Technical Paper Series, Paper No. 890409, Feb. 27-Mar. 3, 1989.

Metals Handbook, 9th Edition, vol. 7, "Powder Metallurgy," *American Society for Metals,* (1984), p. 4, 25-39, 100-104, 683, 351-359, and 360-368.

D. Smith et al., "The Influence of Microstructure on the Pore-Free Density of Powder Forged Steel," Advances in Powder Metallurgy-1991, vol. 3, Jun. 9-12, 1991.

*Primary Examiner*—Charles T. Jordan

[57] ABSTRACT

Methods for preparing sintered components from iron-containing and alloy steel powder are provided. The methods includes compacting a powder mixture in a die set at a pressure of at least about 25 tsi to produce a green compact which is then presintered at a temperature of about 1100°-1600° F. (593°-870° C.) for at least about 5 minutes to produce a presintered preform. The presintered perform is then compacted at a pressure of at least about 25 tsi to produce a double-pressed presintered preform, which is, in turn, sintered at a temperature of at least about 1000° C. for at least about 5 minutes to produce a sintered component having improved transverse rupture strength and a higher density.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–19 are cancelled.

* * * * *